United States Patent [19]

Benson et al.

[11] Patent Number: 4,700,629

[45] Date of Patent: Oct. 20, 1987

[54] OPTICALLY-ENERGIZED, EMP-RESISTANT, FAST-ACTING, EXPLOSION INITIATING DEVICE

[75] Inventors: David A. Benson; Glenn W. Kuswa, both of Albuquerque, N. Mex.

[73] Assignee: The United States of America as represented by the United States Department of Energy, Washington, D.C.

[21] Appl. No.: 859,165

[22] Filed: May 2, 1986

[51] Int. Cl.[4] ..... F42C 19/08

[52] U.S. Cl. ..... 102/201

[58] Field of Search ..... 102/201, 206, 207

[56] References Cited

U.S. PATENT DOCUMENTS

| | | | |
|---|---|---|---|
| 3,408,937 | 11/1968 | Lewis et al. | 102/201 |
| 3,528,372 | 9/1970 | Lewis et al. | 102/201 |
| 3,724,383 | 4/1973 | Gallaghan et al. | 102/201 |
| 4,091,734 | 5/1978 | Redmond et al. | 102/207 |
| 4,149,466 | 4/1979 | Fojt et al. | 102/201 |
| 4,318,342 | 3/1982 | Chandler | 102/201 |
| 4,391,195 | 7/1983 | Shann | 102/201 |
| 4,414,901 | 11/1983 | Sellwood | 102/206 |
| 4,455,941 | 6/1984 | Walker et al. | 102/201 |

*Primary Examiner*—Charles T. Jordan

*Attorney, Agent, or Firm*—George H. Libman; Judson R. Hightower

[57] ABSTRACT

Optical energy, provided from a remote user-operated source, is utilized to initially electrically charge a capacitor in a circuit that also contains an explosion initiating transducer in contact with a small explosive train contained in an attachable housing. Additional optical energy is subsequently supplied in a preferred embodiment to an optically responsive phototransistor acting in conjunction with a silicon controlled rectifer to release the stored electrical energy through the explosion initiating transducer to set off the explosive train. All energy transfers between the user and the explosive apparatus, either for charging it up or for setting it off, are conveyed optically and may be accomplished in a single optical fiber with coding to distinguish between specific optical energy transfers and between these and any extraneous signals.

15 Claims, 3 Drawing Figures

OPTICALLY-ENERGIZED, EMP-RESISTANT, FAST-ACTING, EXPLOSION INITIATING DEVICE

The U.S. Government has rights in this invention pursuant to Contract No. DE-AC04-76DP00789 between the U.S. Department of Energy and AT&T Technologies, Inc.

BACKGROUND OF THE INVENTION

1. FIELD OF THE INVENTION

This invention relates generally to explosive igniters and, more particularly, toward fiber optic coupled, light responsive explosive igniters that are resistant to strong electromagnetic pulses.

2. HISTORY OF THE PRIOR ART

There are many practical applications in which it is necessary to have one or more well-timed explosions. For example, explosive bolts are used on spacecraft to separate successive stages of a vehicle, sequentially actuated shaped charges are often utilized to bring down old dilapidated buildings, and precisely timed initiating explosions are utilized to set off larger quantities of working explosives underground for the generation of strata cleavage in the mining of crude oil and subterranean water sources. In this context, the working explosive usually is a relatively large amount of relatively insensitive explosive material and the initiating explosive (which explodes first in time) is a relatively small quantity of explosive material. Military applications include explosive weapons, triggering of guns, launching of rockets, and the setting off of explosive mines with precise timing. In all of these cases, it is absolutely essential that the initiation of the explosion be a controlled event that is not subject to random inputs such as extraneous noise, radio signals or other electromagnetic pulse inputs, or disruptive signals deliberately generated by saboteurs.

The use of electrical wiring between controls operated by a user and the location of the explosive device itself is particularly vulnerable to weather related electrical potential gradients, extraneous radio signals, proximity to high voltage electrical lines, and to physical damage whether accidental or intentional. There is the additional danger of a possible ground loop through wet terrain leading to an unintended or ill-timed firing of the explosive device. In applications requiring concealment, the wiring may provide a means of easy detection of the explosive device. There is, therefore, considerable interest in utilizing optical fibers or other optical links in place of electrical wiring to an explosive component. With optical communication between the user and the device it becomes somewhat easier to circumvent inadvertent or covert tampering with such devices as well, generally through the use of temporal and spectral coding techniques.

While direct initiation of powerful explosions by a pulse of light is sometimes used, this requires either light intensity levels whhich are difficult to generate and communicate over useful distances or optically sensitive primary explosive materials. Such materials tend to be very sensitive to mechanical inputs, and this tends to defeat any safety advantages gained from optical coupling between the user operated controls and the explosive devices. Although efforts have been made to directly initiate intermediate explosives with intense light pulses, the energy required to accomplish this function appears generally to be well above what one can envision in a practical component design.

For all the above-discussed types of applications, it is convenient to have a self-contained device that contains a small quantity of explosive material that can be set off by an externally provided signal. Where the small quantity of explosive so exploded is to initiate the explosion of a much larger quantity of working explosive material, the device must be attached to a quantity of the explosive material, preferably a container of the same. For those applications where the explosion of a small quantity of explosive material contained within the device will suffice, the device must be attached to a conduit that will carry the force of the explosion to achieve the desired purpose. For either type of use, a secure and convenient technique for attaching the device where it is to be used is to employ a positive mechanical linkage.

Examples of known devices known include, for example, one in which the explosive is ignited by high level, monochromatic, radiant energy derived from some form of laser and conveyed to the explosive through an optical fiber, as in U.S. Pat. No. 3,408,937. In U.S. Pat. No. 3,528,372, a device utilizes an infrared laser to ignite a heat-sensitive small charge in a frangible thin-bottomed container from which metallic fragments are propelled at high velocities to set off a relatively insensitive high explosive charge. A device in U.S. Pat. No. 4,149,466 uses an intermediate source of light in the ignition process for precise timing but requires a primary connection to the explosive device through electrical wiring. A somewhat different approach in U.S. Pat. No. 3,724,383 utilizes a succession of secondary explosives, e.g., KHND and PETN initiated by a low energy laser beam to give a higher order detonation. For blasting operations where a plurality of blast holes must first be drilled and an explosive loaded into each together with a primer and a detonating cord for each such blast hole, one technique proposed in U.S. Pat. No. 4,455,941 has an optical fiber coupled to each electrical wire leading to the blasting caps so that if there is a break in the wire there is also a contemporaneous break in the optical cable, which can be detected by the user prior to setting off synchronized plural explosions. The described prior art requires the use of either light sensitive explosive or a very high intensity light source, e.g., a laser. Such light-sensitive explosives may be subject to ill-timed explosions in response to extraneous X-ray pulses or intense shock waves. Deliberate interference with the fiber optic cable could be used for sabotage purposes merely by coupling a laser or other bright light source to the cable.

There is therefore a need, in both commercial and military applications, for an explosion-initiating device that is insensitive to extraneous electromagnetic radiation, requires no electrical wiring that may be subject to the formation of a ground loop leading to unintended firing of the explosive device, and utilizes low-intensity light transmission through conventional optical fibers, with optional safety coding, to arm and then to set off an explosive device in response to an optically transmitted command.

SUMMARY OF THE INVENTION

Accordingly, it is an object of this invention to provide an explosion-initiating apparatus that is optically energized and controlled, is fast-acting, and is resistant to extraneous electromagnetic radiation.

It is another object of this invention to provide an explosion-initiating apparatus that is optically energized and controlled, fast-acting, resistant to extraneous electromagnetic radiation, and capable of becoming automatically disarmed if not set off within a predetermined time.

It is a further object of this invention to provide explosion-initiating apparatus that is optically energized and controlled, fast-acting, resistant to extraneous electromagnetic radiation, and capable of informing a user when it is in an armed state and ready for initiating an explosion.

It is yet a further object of this invention to provide explosion-initiating apparatus that is optically energized and controlled, fast-acting, resistant to extraneous electromagnetic radiation, and capable of responding selectively only to a signal that meets predetermined criteria for setting off an explosive.

It is still another object of this invention to provide for the enhanced concealment of an explosion initiating device which uses only difficult to detect interconnections by fiber or other optical paths.

It is also an object of this invention to provide a method, utilizing only optical energy to controllably explode a quantity of explosive material either by deflagration or detonation depending upon the explosive material selected.

It is another object of this invention to provide an explosive initiating device having a unique code installed therein for the purpose of preventing compromise of the overall code by capture and analysis of a single one of a plurality of similar devices.

It is yet a further object that the device be capable of responding to a unique code for purposes of having individual units triggered on command through a single fiber optic link from the control system. Thus, a single fiber optic or other means of transmitting optical energy may connect the control system to a branch point from which other optical links are connected to individual optical triggering devices.

It is yet a further object that the invention be capable of being completely surrounded by an electrically conducting housing, except for a single small penetration, thus making the contents immune from extraneous electromagnetic pulses. Furthermore, in extraordinary circumstances, an optically transparent but electrically conducting material may be placed over the penetration to further attenuate extraneous electromagnetic pulses. One such material for example may be a film of tin oxide.

These and other objects of this invention are realized by providing apparatus contained in a securely attachable housing, optically coupled to an external source of optical energy, which housing contains a circuit containing a first energy transducer which first converts optical energy into stored electrical energy and an optically responsive second transducer which releases this stored electrical energy in response to a pulse of optical energy to set off an explosive train comprising a quantity of explosive material contained in the housing.

DESCRIPTION OF THE DRAWINGS

Other and further advantageous features of the present invention will hereinafter more fully appear in connection with a detailed description of the drawings, in which.

DESCRIPTION OF THE PREFERRED EMBODIMENT

Figure 1:
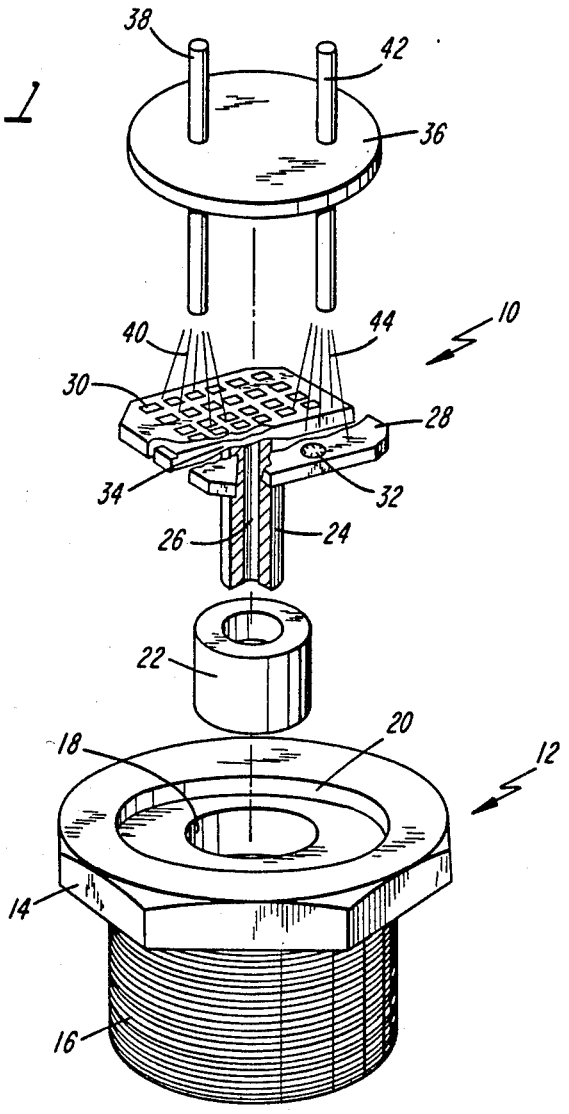
FIG. 1 is an exploded perspective view, partially sectioned, of the principal elements of a preferred embodiment of this invention.

Referring to FIG. 1, a preferred embodiment of this invention includes a device housing body 12 provided with a portion preferably having a hexagonal external profile 14 and an externally threaded portion 16 suitable for threaded attachment to other objects. Housing body 12 is provided with an axially oriented bore 18. The hexagonally shaped portion 14 allows the application of an external torque, e.g., as by a wrench, to firmly thread the housing body 12 into a compatible internally threaded fitting (not shown).

Centrally within the hexagonal portion 14 is an axially symmetric recess 20 within which is contained a circuit 10, preferably an integrated circuit formed on a dielectric substrate 28. It should be understood that other forms of such a circuit, e.g., with discrete elements, requiring differently sized or shaped recesses to accommodate them, are also feasible. An annularly cylindrical capacitor 22, to store electrical energy provided by a portion of circuit 10, is conveniently contained within bore 18. Within the central bore of capacitor 22 is located a steel explosive chamber 24, also of annularly cylindrical form open at both ends. Within the central bore of explosive chamber 24 is a cylindrical explosive train 26, composed preferably of granular explosive material treated to maintain its physical integrity while the device is being transported or in use. Explosive train 26 therefore has the form of a solid cylinder coaxial within the device and contained principally within the steel explosive chamber 24.

As best seen in FIG. 1, substrate 28, in the integrated circuit version of circuit 10, is provided at its lower side, and hence adjacent to one end of explosive train 26, with a transducer 34 capable of converting electrical energy into an energy suitable for setting off explosive train 26, as more fully discussed hereinafter. On the other side of substrate 28 is provided with an array 30 of photovoltaic cells, to serve as another transducer to convert optical energy into an electrical current. This optically-generated electrical current is provided to capacitor 22 to accumulate electrical charge thereon to subsequently provide electrical energy to set off explosive train 26. Adjacent to photovoltaic array 30 is a photo-transistor 32 which is to react to a quantity of optical energy to release the electrical charge stored in capacitor 22 to transducer 34 for further conversion into an energy form suitable for setting off explosive train 26.

Photovoltaic array 30 is provided with a first quantity of optical energy 40, preferably in the form of visible light, by an optical fiber 38. Similarly, phototransistor 32 is provided with a second quantity of optical energy 44 by means of an optical fiber 42. Optical fibers 38 and 42 pass through a mounting cover 36 which may be attached to the device housing body 12 in any convenient manner. Optical fibers 38 and 42 are either affixed adhesively to apertures provided therefor in cover 36 or passed through known commercially available optical connectors integral with cover 36.

It should be understood that in the process of assembling the various components, capacitor 22, transducer 34, photovoltaic array 30, phototransistor 32, and other necessary electrical elements are all correctly coupled together to form circuit 10. The entire circuit, with the possible exception of the capacitor 22, if formed as an integrated circuit, can be made very small.

Figure 2:
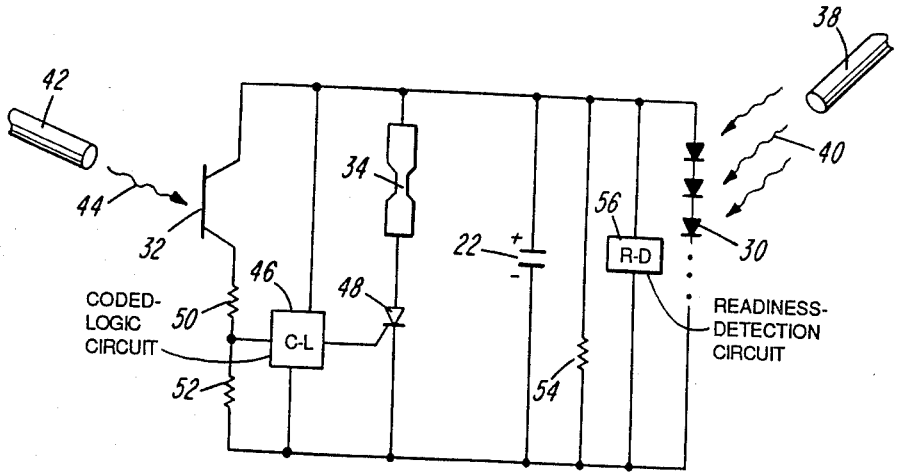
FIG. 2 is a schematic circuit diagram of a preferred embodiment of this invention.

FIG. 2 is a schematic diagram of circuit 10 for a preferred embodiment of this invention. Thus photovoltaic cell array 30 receives a first quantity of charging energy 40 via optical fiber 38 to produce a current that charges capacitor 22 connected in parallel to photovoltaic array 30. Also connected to capacitor 22, are transducer 34, a silicon controlled rectifier (SCR) 48, a phototransistor 32 for receiving a second quantity of energy 44 via fiber optic cable 42, and resistors 50 and 52 connected as shown. This much of the circuit 10 would suffice to perform the necessary functions as described more fully hereinbelow. However, as shown in FIG. 2, it may be convenient also to include any or all of the following optional elements in circuit 10. One such optional element for inclusion in circuit 10 is a bleeder resistor 54, to discharge capacitor 22 slowly, to ensure that if a firing signal is not provided within a predetermined time after the charging of capacitor 22, capacitor 22 will automatically discharge and be unable to fire explosive train 26. It may also be desirable to add an optional readiness-detection circuit 56, of known kind, such as a voltage level detector, whose function is to determine whether capacitor 22 has acquired a predetermined amount of electrical charge and to so inform the user. Preferably, this information is provided by means of a photodiode sending a signal, which may be coded, back through the same optical fiber 38 through which energy was provided to photovoltaic array 30. Where the security aspects are very important it may be desirable to also add an optional coded logic circuit 46, of known kind, whose function is to ensure that incoming optical signal 44 is unique to the authorized sender thereof and meets certain predetermined criteria, e.g., it satisfies a certain digital code check and is not an extraneous, accidental, or sabotaging signal. The optical charging function may also be made selective through coding techiques. Such coded logic circuits are commonly used to ensure the security of business and other proprietory data, e.g., bank accounts and the like, and are well-known to persons skilled in the art.

Figure 3:
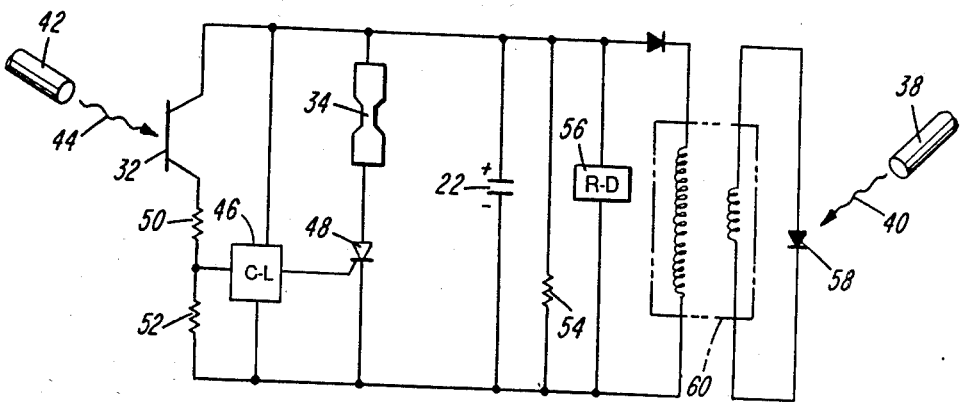
FIG. 3 is a schematic circuit diagram of another embodiment of this invention.

Depending on the type of explosive material utilized for a particular need, it may be necessary to provide different amounts of energy to transducer 34 to obtain the desired explosion. Therefore, in an alternative embodiment best seen in circuit form in FIG. 3, optical energy 40 carried by optical fiber 38 is provided to one or more photodiodes 58 which generate a current in one winding of a coupling transformer 60. A second winding of coupling transformer 60 is made a part of the basic integrated circuit which contains capacitor 22 and transducer 34 together with the assorted circuit elements previously discussed. By preselection of the ratio of the number of turns in the different windings in coupling transformer 60, it is possible for a low voltage current generated by photodiode 58 to provide an adequate high voltage small current to capacitor 22 for the charging thereof. In this embodiment, therefore, a relatively weak source of optical energy 40 can be utilized, over time, to charge a relatively large capacitor 22 at a stepped-up voltage with sufficient electrical energy to power a substantially demanding transducer 34. Thus the charging portion of the circuit is inductively coupled to the firing portion of the circuit in this embodiment. As will be apparent to persons skilled in the art, optional elements such as bleeding resistor 54, readiness-deduction circuit 56 and coded logic circuit 46 may be advantageously included in the circuit 10 as indicated in FIG. 3.

Given a device constituted as described above, a user therefore locates the device by attachment of housing 16 to a suitable object. Depending on the application at hand, this object may be a large container of a explosive or equipment that will be receiving the force of a small explosion to perform a function. Optical fibers 38 and 42 are then individually connected to a source of optical energy, this source being under the control of the user at a location generally remote from the explosive device. Persons skilled in the art will appreciate that it is not essential that optical fibers 38 and 42 be separate. In other words, by combining the two into a single optical fiber a user may provide charging optical energy 40 within a particular frequency range, for example, and also utilize the same optical fiber to provide the optical firing energy 44 at a different frequency or in a predetermined coded manner. Such transmission of multiple but separately useful optical signals in a common optical fiber is well known in the art. In such use, it would be logical to have the incoming light, whether it carries charging optical energy 40 or firing optical energy 44, to impinge on both the photovoltaic array 30 and phototransitor 32 simultaneously.

Once the device is in place, the user thus provides optical energy to charging capcitor 22 and, subsequent to an adequate charge being collected in capacitor 22, an optical firing signal is provided via the optical fiber link to phototransistor 32. Phototransistor 32, in conjunction with resistors 50 and 52 as well as silicon controlled rectifier 48, serves as a fast-acting switch which releases the electrical energy stored in capacitor 22 through transducer 34 to produce a precisely-timed explosion of explosive train 26. It should be understood that if optional coded logic circuit 46 is provided then it will perform its function to ensure that the firing signal is correct.

It is well known to those practiced in the art that various other photoconductive devices in addition to photo-transistors may be suitably applied.

The term capacitor as used herein should be understood to include any energy device capable of being charged with electric energy, and retaining that energy in such manner that it can be discharged through an electrical triggering device with sufficient rapidity to actuate the particular mentioned devices that actuate the explosive. Examples of such devices would include capacitors in which energy is stored in electrostatic form, batteries in which energy is stored chemically, or other devices known to those who practice the art of energy storage.

It should be appreciated that this invention provides for a device utilizing relatively small quantities of energy, delivered optically to the device, not only to charge up the system but to discharge the stored energy promptly to produce explosion-initiation upon the firing signal being received. It should therefore be apparent that transducer 34 must be capable of setting off the explosion of explosive train 26 with a very small amount of energy. Certain explosive materials require a high temperature ignition to initiate the chemical process which proceeds by deflagration to very quickly generate chemical by-products that produce the desired heat, light or gaseous output. Such materials are particularly convenient to use where the "explosion" is to cause a piston to move, e.g., to open or close a valve swiftly or to actuate a cutting mechanism. Other explosives such as HMX or RDX, are preferably set off by a detonation, i.e., by the provision of energy in the form of a shock wave which travels at the speed of sound through the explosive train to cause the chemical reaction which results in a detonation. Therefore, depending on the type of explosive to be used to suit particular circumstances, transducer 34 must provide the requisite energy either in the form of a very high temperature zone or as a pressure wave to set off explosive train 26. It should be noted that the term "igniters" is often used as a generic term for either type of transducer.

One type of transducer 34, known as a "semiconductor bridge igniter (SCB)" is the subject of a U.S. patent application Ser. No. 702,716, filed on Feb. 19, 1985 by Robert W. Bickes, Jr. and Alfred C. Schwarz, titled "Semiconductor Bridge Igniter", assigned to the U.S. Government, which is incorporated herein by reference. This device produces a very high temperature zone utilizing a very small amount of electrical energy, thus making it a suitable transducer for producing a deflagration-to-detonation transition within explosive train 26. Other devices, such as the well-known hot wire type devices, may be used with equal facility with explosives that require a deflagration. The present invention, of course, is not limited to any particular type of transducer 34. In essence, any energy releasing switch that can be triggered by an optical energy input to release sufficient energy to initiate explosion of explosive train 26 would be effective.

It is well-known that the presence of metallic conductors in explosive devices such as land or underwater mines can lead to compromising the location of the explosive. This is a matter of great concern in military applications. It is therefore apparent that an all-optical link with a very small volume device and containing a minimum of conducting or magnetic material can make the device very hard to detect, thus enhancing its utility in the military field. The present invention is well suited to meet this need.

A photovoltaic cell 30 made from a 10 by 10 array of photodiodes is capable of producing electrical voltage in the 30 to 50 volt range. Existing commercial photocell technology is able to provide specific power levels of $2\times10^{-3}$ watts/cm$^2$ for modest continuous light levels. Thus, using a 1 cm$^2$ area, such an array should provide $2\times10^{-3}$ watts of electrical power to charge capacitor 22. If a 5 $\mu$F capacitor 22 is used to store electrical energy, a charge voltage of 50 volts would store 6.25 mJ of energy, which is more than sufficient for a device employing an explosive train of HMX or pyrotechnics material such as THKP (Titanium subhydride potassium perchlorate). This level of charging energy can be produced by light on such a photodiode array in 3 to 5 seconds. If longer charge times are acceptable, then that portion of integrated circuit 10 which is devoted to the photovoltaic cell 30 can be reduced further.

The time delay from the firing signal to the actual output of a detonation front from such a device is a consequence of several processes, which together typically require less than 100 $\mu$s. If the transducer 34 which converts the electrical stored energy of capacitor 22 into the requisite energy pulse to set off explosive train 26 is of the semiconductor bridge (SCB) igniter type then, under the conditions listed in the preceding paragraph the, actual ignition time is of the order of about 50 $\mu$s. Persons skilled in the art are expected to be able to readily select appropriate transducers 34 and explosie trains 26 and to determine the required times and optical energy quanta required to operate the apparatus of this invention for particular applications.

It should be apparent from the preceding that the invention may be practiced otherwise than as specifically described and disclosed herein. Modifications may, therefore, be made to the specific embodiments disclosed here without departing from the scope of this invention, and are intended to be included within the claims appended below.

We claim:

1. An EMP-resistant, fast-acting device, energized and controlled by an external source of optical energy for exploding a quantity of explosive material for providing explosive force to an external object, comprising:

a housing, provided with a containment space extending to an outer surface of said housing for containing a quantity of explosive material adjacent said outer surface;

an optically energizable circuit contained in said housing,in communication with said explosive material, said circuit comprising:

first energy transducer means for converting a first quantity of optical energy into stored electrical energy; and optically-responsive energy release means for converting said stored electrical energy into an energy pulse to actuate said explosive material in response to a second quantity of optical energy; and optical coupling means, optically coupling said circuit to said external source of optical energy, for transmission of said first and second quantities of optical energy from said external source to said first energy transducer means and said energy release means, respectively.

2. An explosion initiating device according to claim 1, wherein:

said first energy transducer means comprises a photovoltaic cell and a capacitor.

3. An explosion initiating device according to claim 2, further comprising:

a high electrical resistance resistor, connected in parallel across said energy storage means, for discharging said stored electrical energy therefrom at a predetermined slow rate.

4. An explosion initiating device of claim 2 wherein said optically energizable circuit further comprises a step-up transformer having an input set of windings connected to said photovoltaic cell and an output set of windings connected to said capacitor.

5. An explosion initiating device according to claim 2 wherein said containment space is a round hole extending from said outer surface into said housing, said capacitor is an annular cylinder positioned within said containment space, and said explosive material is positioned within said annular cylinder.

6. An explosion initiating device according to claim 1, further comprising:

charge verification means coupled to said first transducer means for verifying that at least a predetermined minimum amount of electrical energy is stored by said first transducer means.

7. An explosion initiating device according to claim 1, wherein:

said optical coupling means comprises at least one optical fiber linking said external source of optical energy to said housing.

8. An explosion initiating device according to claim 1, further comprising:

coded logic function means, coupled to said optically-responsive energy release means, for passing only that transmission of said second quantity of optical energy to said optically-responsive energy release means which satisfies a predetermined coded criterion.

9. An explosion initiating device according to claim 1, wherein said optically-responsive energy release means comprises:

second energy transducer means, adjacent said explosive, for converting the released stored electrical energy into the energy pulse; and light controlled electrical switch means for controlling the transmission of said stored electrical energy to said second transducer means in response to said second quantity of optical energy.

10. An explosion initiating device according to claim 9, wherein:

said first energy transducer means comprises:

a photovoltaic cell for converting received optical energy into electrical energy , and an energy storage means connected to said photovoltaic cell to store the electrical energy.

11. An explosion initiating device according to claim 10, wherein:

said optically-energizable circuit is formed with a dielectric substrate, said photovoltaic cell and said switch means being located on a first side of said substrate adjacent a portion of said optical coupling means, and said second energy transducer means being located on a second side of said substrate adjacent a portion of said explosive train.

12. The device of claim 9, wherein:

said second energy transducer means comprises a semiconductor bridge igniter device.

13. The device of claim 9, wherein:

said second energy transducer means includes means for transducing said release of said stored electrical energy into thermal energy to generate a locally high temperature to explode said explosive train by deflagration.

14. The device of claim 9, wherein:

said second energy transducer means includes means for transducing said release of said stored electrical energy into mechanical energy to generate a local shock wave to explode said explosive train by detonation.

15. An explosion initiating device according to claim 9, wherein said light controlled electrical switch means comprises a phototransistor coupled to trigger a silicon controlled rectifier, said rectifier being series connected with said second energy transducer means and said first energy transducer means.

* * * * *